US011452916B1

(12) United States Patent
Kahn et al.

(10) Patent No.: US 11,452,916 B1
(45) Date of Patent: Sep. 27, 2022

(54) MONITORING EXERCISE SURFACE SYSTEM

(71) Applicants: Philippe Richard Kahn, Santa Cruz, CA (US); Sonia Lee Kahn, Santa Cruz, CA (US); Arthur Kinsolving, Santa Cruz, CA (US); Mark Andrew Christensen, Santa Cruz, CA (US)

(72) Inventors: Philippe Richard Kahn, Santa Cruz, CA (US); Sonia Lee Kahn, Santa Cruz, CA (US); Arthur Kinsolving, Santa Cruz, CA (US); Mark Andrew Christensen, Santa Cruz, CA (US)

(73) Assignee: DP Technologies, Inc., Scotts Valley, CA (US)

( * ) Notice: Subject to any disclaimer, the term of this patent is extended or adjusted under 35 U.S.C. 154(b) by 250 days.

(21) Appl. No.: 16/746,773

(22) Filed: Jan. 17, 2020

Related U.S. Application Data

(60) Provisional application No. 62/793,864, filed on Jan. 17, 2019.

(51) Int. Cl.
*A63B 24/00* (2006.01)
*A63B 21/00* (2006.01)

(52) U.S. Cl.
CPC ..... *A63B 24/0075* (2013.01); *A63B 21/4037* (2015.10); *A63B 24/0062* (2013.01); *A63B 2024/0071* (2013.01); *A63B 2024/0081* (2013.01)

(58) Field of Classification Search
CPC ..... A63B 24/0075; A63B 21/4037; A63B 24/0062; A63B 2024/0071; A63B 2024/0081
See application file for complete search history.

(56) References Cited

U.S. PATENT DOCUMENTS 6,336,891 B1 * 1/2002 Fedrigon ..... A63B 24/0006 482/8
9,586,120 B1 * 3/2017 Sotelo ..... A63H 13/06
2008/0293553 A1 * 11/2008 Hanspall ..... A63B 21/4037 482/140
2010/0076347 A1 * 3/2010 McGrath ..... G16H 20/30 600/595
2010/0125027 A1 * 5/2010 Abiemo ..... A63B 24/0062 482/8
2010/0234183 A1 * 9/2010 Mar ..... A63B 21/4037 482/8
2012/0058861 A1 * 3/2012 Satut ..... H01H 3/141 482/8
2012/0115682 A1 * 5/2012 Homsi ..... G16H 20/30 482/8
2013/0224708 A1 * 8/2013 Martin ..... A61B 5/112 434/247
2015/0297128 A1 * 10/2015 Shield ..... A63B 21/4029 600/595
2015/0321039 A1 * 11/2015 Howe ..... G01B 21/32 482/8

(Continued)

*Primary Examiner* — Sundhara M Ganesan
(74) *Attorney, Agent, or Firm* — Nicholson De Vos Webster & Elliott LLP; Judith Szepesi

(57) ABSTRACT

A yoga under-mat to be positioned under an exercise mat, to make the exercise mat a smart mat. The yoga under-mat including a plurality of sensors to monitor a user's health data, while the user is performing exercises, and to provide data to the user.

20 Claims, 9 Drawing Sheets

(56) References Cited

U.S. PATENT DOCUMENTS

| | | | | |
|---|---|---|---|---|
| 2015/0364059 | A1* | 12/2015 | Marks | A61B 5/486 482/9 |
| 2016/0166876 | A1* | 6/2016 | Goh | A63B 21/4037 482/9 |
| 2016/0243395 | A1* | 8/2016 | Ban | A61H 9/0078 |
| 2016/0361596 | A1* | 12/2016 | Brogmus | G09B 19/0038 |
| 2017/0028257 | A1* | 2/2017 | Hierzer | G16H 20/30 |
| 2017/0028258 | A1* | 2/2017 | Liu | G16H 20/30 |
| 2017/0080279 | A1* | 3/2017 | Arredondo | A63B 71/0669 |
| 2017/0100631 | A1* | 4/2017 | Wu | A63B 23/0216 |
| 2017/0177084 | A1* | 6/2017 | Mangharam | G06F 3/0484 |
| 2017/0209742 | A1* | 7/2017 | Merkel | A61B 5/1116 |
| 2017/0304672 | A1* | 10/2017 | Tsai | A63B 21/4037 |
| 2018/0021629 | A1* | 1/2018 | DeLuca | A63B 24/0059 482/4 |
| 2018/0043205 | A1* | 2/2018 | Duffy | A63B 21/4037 |
| 2018/0317813 | A1* | 11/2018 | Hall | A61B 5/6892 |
| 2019/0118066 | A1* | 4/2019 | Cardona | G09B 19/0092 |
| 2019/0275403 | A1* | 9/2019 | Rudan | A41D 19/0055 |
| 2020/0254299 | A1* | 8/2020 | Kanuparthi | A63B 24/0062 |
| 2020/0265746 | A1* | 8/2020 | Derwinger | A63B 21/4033 |
| 2020/0276476 | A1* | 9/2020 | Luzzatto | A63B 21/005 |
| 2021/0331036 | A1* | 10/2021 | Gai | A63B 26/00 |

* cited by examiner

MONITORING EXERCISE SURFACE SYSTEM

RELATED APPLICATION

The present application claims priority to U.S. Provisional Patent Application No. 62/793,864, filed on Jan. 17, 2019, and incorporates that application in its entirety.

FIELD

The present invention relates to exercise, and more particularly to a monitoring system for an exercise surface.

BACKGROUND

Yoga and other exercises are often done on mats or special flooring that provides a resilient and non-slip surface that enables the user to perform exercises. Such mats are useful but could provide more information.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

A universal under-mat for exercise surfaces such as yoga mats is described. This universal thin layer may be placed under any exercise mat or other exercise surface. The under-mat is designed to be light weight, and to be easily rolled up within an exercise mat. Use of the under-mat turns any exercise mat into a smart mat. This enables users to utilize whatever mat they prefer, and also enables a gym or similar location to provide under-mats to users, regardless of what kind of exercise mat they own. By utilizing an under-mat which is not directly in contact with the user's body, and sweat, the under-mat can be simplified and does not need to be able to be washed down. In one embodiment, the under-mat may have different sensing geometries, depending on the type(s) of exercise which may be done on the mat. This under-mat will be referred to as a yoga under mat in the present application, but one of skill in the art would understand that the under-mat may be used for any exercise, stretching, meditation, or other contexts.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized, and that logical, mechanical, electrical, functional and other changes may be made without departing from the scope of the present invention. The following detailed description is, therefore, not to be taken in a limiting sense, and the scope of the present invention is defined only by the appended claims.

Figure 1A:
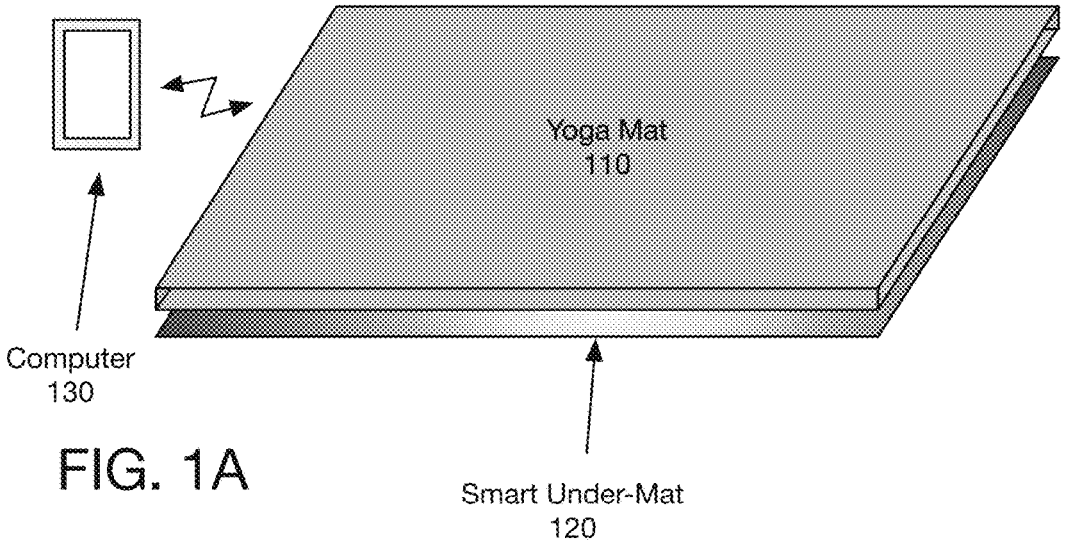
FIGS. 1A and 1B are illustrations of one embodiment of a yoga mat and yoga under-mat in accordance with embodiments.
Figure 1B:
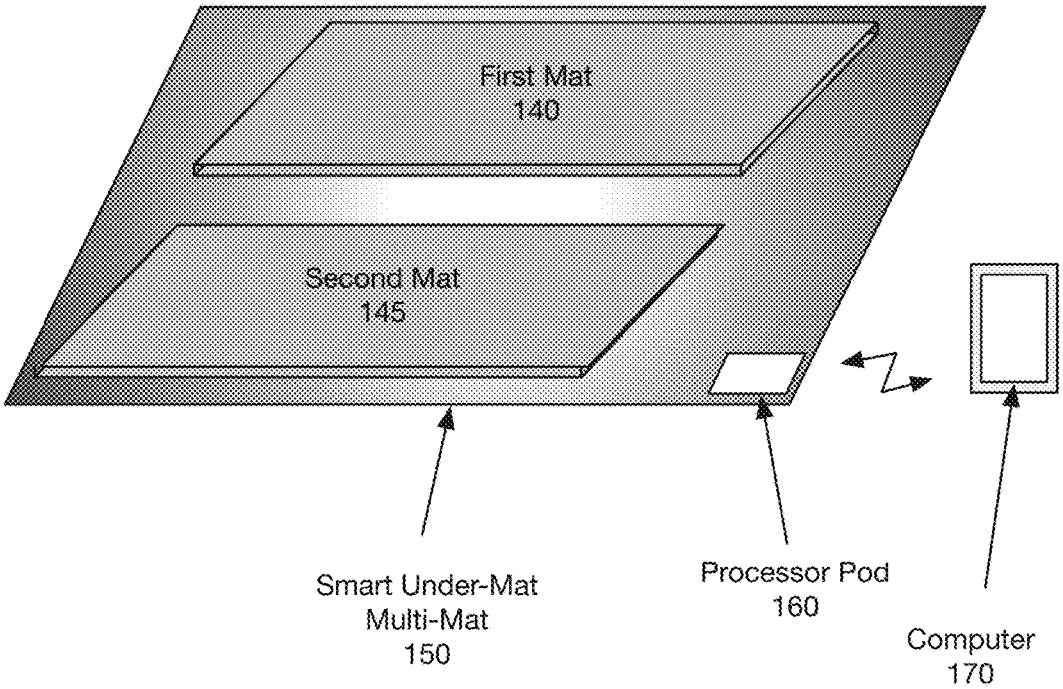

FIGS. 1A and 1B are illustrations of one embodiment of a yoga mat and yoga under-mat in accordance with embodiments. The smart under-mat 120 in one embodiment is designed to be positioned under a yoga mat 110, or other exercise mat. The smart under-mat 120 provides sensing. In one embodiment, the smart under-mat 120 may also provide processing. In one embodiment, the smart under-mat 120 may provide user interface features.

In one embodiment, the smart under-mat 120 is a special purpose computing device which includes a plurality of sensors, and a signal processor, which receives the data from the plurality of sensors. In one embodiment, the signal processor converts the signal data to digital data, and sends it to the special purpose computing device, which processes the sensor data and generates feedback to the user. In one embodiment, the feedback may be real-time feedback. The feedback may alternatively or additionally be feedback available at the end of a session.

In one embodiment, the smart under-mat 120 communicates with a computer 130. The computer 130, in one embodiment, is coupled wirelessly to the smart under-mat 120. In one embodiment, the computer 130 may be a mobile phone, tablet, laptop, or other device which can provide processing and/or user interface features.

The smart under-mat 120 may be used to make any yoga mat 110 into a "smart yoga mat" which provides feedback and analysis data to the user regarding their exercise. While the illustration shows the yoga mat 110 and smart under-mat 120 being approximately the same size this Is not necessary. Any yoga mat 110 or other exercise mat regardless of size may be used. In a preferred embodiment, the smart under-mat 120 covers at least 70% of the area of the yoga mat 110.

FIG. 1B illustrates a large smart under-mat 150 which may be used for one mat 140 or two mats 140, 145. In one embodiment for a smart under-mat that is designed as a multi-mat 150, the system can differentiate between a user on the first mat 140 and the second mat 145.

In one embodiment, the smart under-mat 150 includes a processor pod 160 which provides processing for the sensor data. In one embodiment, the smart under-mat 150 may be self-contained and include a user interface as well as processor pod 160. In another embodiment, the smart under-mat 150 may collect data and send it to computer 170. In one embodiment, computer 170 may not be a local device, such as the user's smart phone, but instead may be a remote computer system. In that instance, processor pod 160 may include a wireless transceiver, which enables smart under-mat 150 to communicate via Wi-Fi, cellular network, or another protocol. A remote computer system may be a distributed or cloud computing system.

Figure 2:
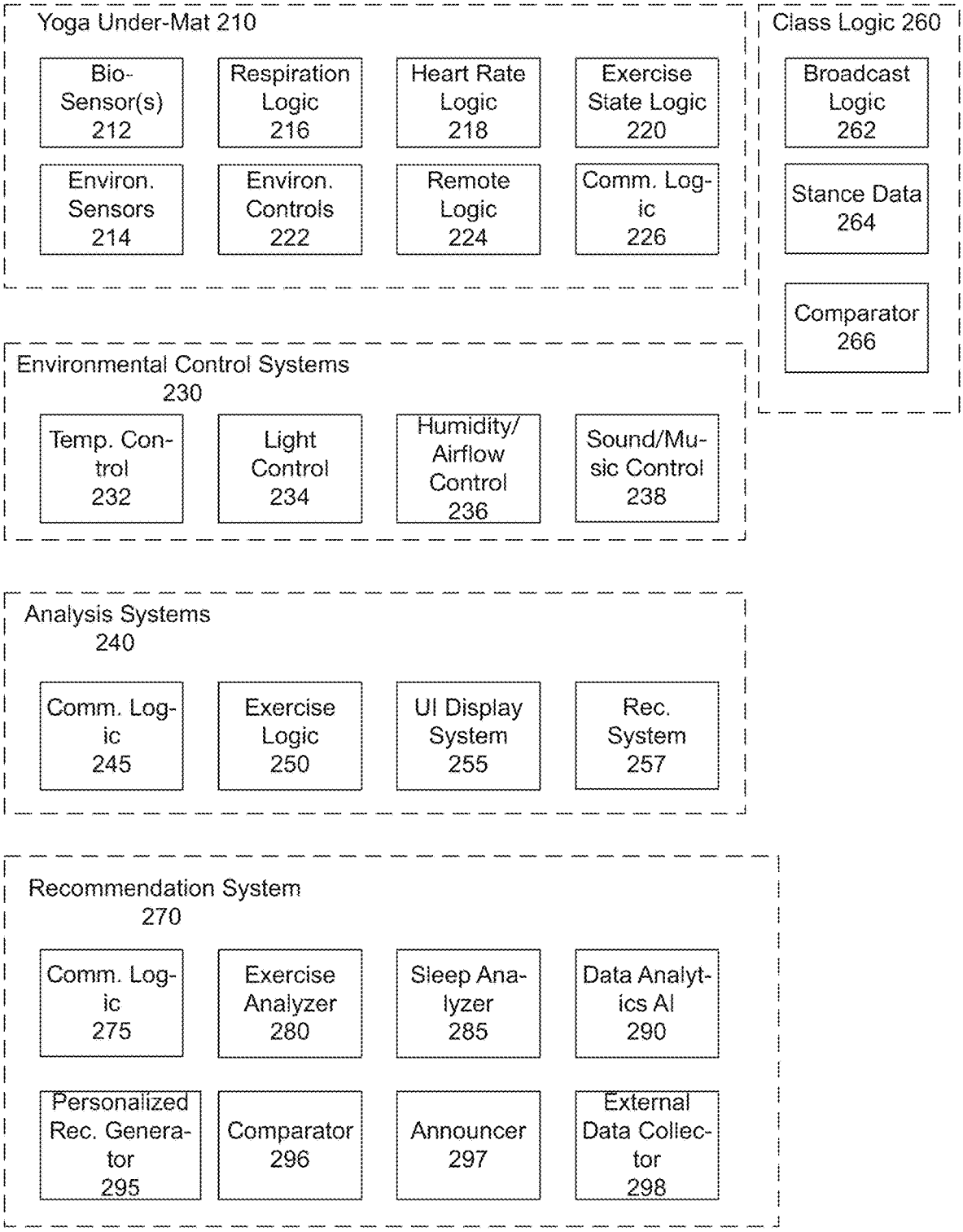
FIG. 2 is a block diagram of one embodiment of the under-mat and system.

FIG. 2 is a block diagram of one embodiment of the yoga under-mat and system. The system includes the smart yoga under-mat 210, environmental control systems 230, analysis systems 240, and recommendation system 270. Although each of these elements is illustrated separately, these functionalities may be provided by a processor pod in the yoga under-mat, the user's mobile device, a computer, and/or a server device, as described with respect to FIGS. 1A and 1B. Additionally elements illustrated in one logical unit may be split between the various devices. A single server, whether singular or distributed, may provide the functionality of analysis systems 240 and recommendation system 270, or those functionalities may be split among multiple systems.

The yoga under-mat 210 includes a plurality of bio-sensors 212 and environmental sensors 214, in one embodiment. Bio-sensors 212 may include sensitive motion sensors, as well as temperature sensors for the user's body, blood pressure sensors, etc. In one embodiment, bio-sensors 212 are one or more inductive sensors. In one embodiment, the sensors 212 are designed to be rolled up and otherwise handled without damage. In one embodiment, the inductive sensor may be pressure and motion sensitive.

Environmental sensors 214 may include environmental temperature, light level, sound, humidity, and other measurements which may influence the user's ability to exercise or meditate, and potential health issues with exercise, such as yoga.

Respiration logic 216 utilizes data from bio-sensors 212 to calculate the user's respiration (breathing patterns). By calculating the rate and depth of respiration, the system can compare the user's breathing pattern to healthy breathing patterns. In one embodiment, this data may be used by recommendation system to provide advice. Heart rate logic 218 determines the user's heart rate, in one embodiment based on data from the inductive sensor and/or other bio-sensors 212.

Exercise state logic 220 utilizes the data from the bio-sensors 212 to determine the user's body position and weight distribution. This data can be used to determine the user's stance for yoga, as well as the user's form for other exercises or movements.

In one embodiment, environmental controls 222 may be utilized to adjusts the environmental conditions in the exercise area, as discussed below. In one embodiment, the environmental controls 222 in one embodiment send data to environmental control systems 230. In one embodiment, the environmental control systems provide IoT (internet of things) controls for the environment. In some embodiments, one or more controls may exist in a system. For example, the environmental control system 230 may turn on a sound/music control 238 to add white noise machine, music, or other sounds. The sound/music control 238 may also make the music louder or softer, in one embodiment. The environmental control systems 230 for example may set the temperature control 232, to adjust the temperature to improve the user's experience. The environmental control system 230 for example may access the light controls 234 to alter the lighting level, making it brighter or dimmer, or adjusting color temperature. Humidity/airflow control 236 may also be adjusted. In one embodiment, in a smart home, or smart office, the environmental controls 222 may be accessed through an API associated with such a smart home/office IoT system, either directly or mediated through an assistant device such as Google Home, Alexa, Siri, etc.

The Yoga under-mat 210 further includes a communication logic 226. The communication logic 226 enables the yoga under-mat 210 to communicate with other systems, including in one embodiment environmental control systems 230. The communication logic 226 may be a wireless connection, to Wi-Fi, or a cellular network connection.

In one embodiment, the yoga under-mat 210 includes a remote logic 224. When the user is participating in a group activity, whether in person or remotely for example via video, in one embodiment, the yoga under-mat 210 may be used to ensure that the user is on-track with the class.

Class logic 260 enables the use of a remote class with the yoga under-mat 210. Class logic 262 includes broadcast logic 262, stand data 264, and comparator 266. Broadcast logic 262 broadcasts a sequence of exercises. In one embodiment, broadcast logic 262 may send data from a real class, with a live teacher. Stance data 264 includes the sequence of stances associated with the broadcast data, and synchronized to the broadcast. In one embodiment, for a live class, the sequence may be triggered by the teacher. For a pre-recorded class, or a remote class, the stance data 264 may be pre-entered. In some embodiments, the system may utilize image data from the class broadcast to calculate the stance data. Comparator 266 compares data from the yoga under-mat 210, indicating the user's actual stance, with the stance data for the current element of the class. The user and/or teacher may be alerted if there is a mismatch. This is described in more detail below with respect to FIG. 5.

Analysis system 240 in one embodiment resides on a server and provides AI analytics. In one embodiment, the analysis system 240 is a server computer system which receives data from the yoga under-mat 210 via communication logic 245. The analysis system 240 in one embodiment, stores this data in a buffer or memory, and utilizes it to provide analytics on the user's yoga/exercise session. Furthermore, the analysis system in one embodiment provides the processed data to the recommendation system 270. In one embodiment, exercise logic 250 evaluates the data from a large number of users and provides analytics. In one embodiment, the exercise logic 250 utilizes, in addition to the data from the various sessions, user characteristic data.

User characteristics, in one embodiment include permanent characteristics such as age, gender, permanent health conditions. User characteristics, in one embodiment, further include changeable characteristics such as athletic level, current illnesses or other issues affecting meditation capability or sleep.

Additionally, the exercise logic 250 may use environmental data, such as the user's location, time of day, and environmental characteristics. The exercise logic 250 in one embodiment uses a deep learning system that creates correlations between users and environments. This data is then passed to the recommendation system 257. In one embodiment, the recommendation system 257 creates "ideal" environmental setting recommendations for users with particular characteristics doing particular types of activities/exercises.

In one embodiment, analysis system 240 further includes a user Interface Display System 255, which calculates and provides to the user statistics about the user's performance. In one embodiment, the user interface further provides recommendations.

In one embodiment, recommendation system 270 receives the data from individual users as well as the analytics data from analysis system 240, via communication logic 275. The recommendation system 270 in one embodiment is a computer system, such as a server or distributed computer system. The data received in one embodiment is stored in a buffer and/or memory.

Exercise analyzer 280 analyzes the user's performance data and provides feedback. In one embodiment, the output of the exercise analyzer 280 provides user feedback about their performance during this session.

Data analytics AI system 290 utilizes the exercise data and other user data, along with analytics data to build up a set of analytics. In one embodiment, a deep learning system is used.

In one embodiment, the data analytics AI system 290 may also receive data from a sleep analyzer 285. Sleep analyzer 285 receives sleep data from a sleep surface such as a smart bed, or a sleep tracking system implemented in a mattress, blanket, pillow, mobile device, or wearable device. Exercise and sleep influence each other, the timing and quality of sleep impacts the timing and quality of exercise. By combining recommendations and analytics in one embodiment, the system can provide recommendations to improve sleep using exercise, and recommendations to improve exercise using sleep. In one embodiment, the system may also receive data from an activity monitor, such as a mobile device or wrist-worn device which monitors the user's other activity level when not using yoga under-mat 210.

Personalized recommendation generator 295 recommends exercise and/or sleep actions for the user. In one embodiment, the personalized recommendation system suggests the timing of subsequent exercise sessions, and optionally specific types of exercises or classes, for optimum impact. In one embodiment, the user may enter an exercise goal (e.g. become more flexible or build core strength) and the system may take into account these goals making recommendations.

Comparator 296 compares the user's data to the data of comparable users. In one embodiment, the comparable users may be identified by the data analytics AI system 290. In one embodiment, comparable users are users with similar user characteristics (age, gender, athletic ability), and similar behavioral characteristics (sleep patterns, habits, etc.) In one embodiment, comparable users also include users with better habits, and the personalized recommendation generator 295 recommends improvements to the user's behaviors.

External data collector 298 may obtain data from the sleep monitor, activity monitor, and other data sources, to improve the recommendations for the user. In one embodiment, the recommendation generator 295 may also provide other recommendations, such as suggested changes to what and when to eat, how much and when to sleep, and/or timing and frequency of other activities.

Figure 3A:
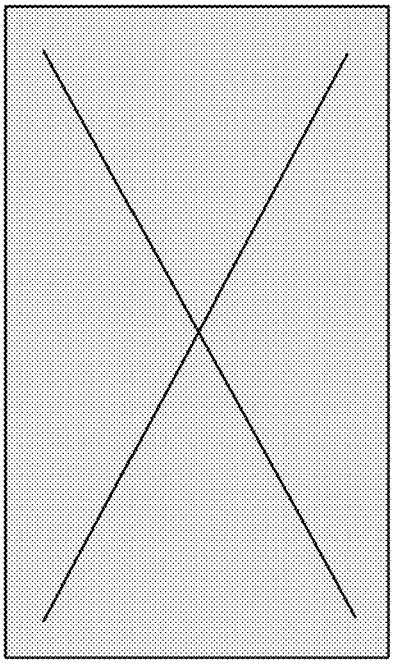
FIG. 3A-3D are illustrations of embodiments of arranging sensors in an under-mat.
Figure 3B:
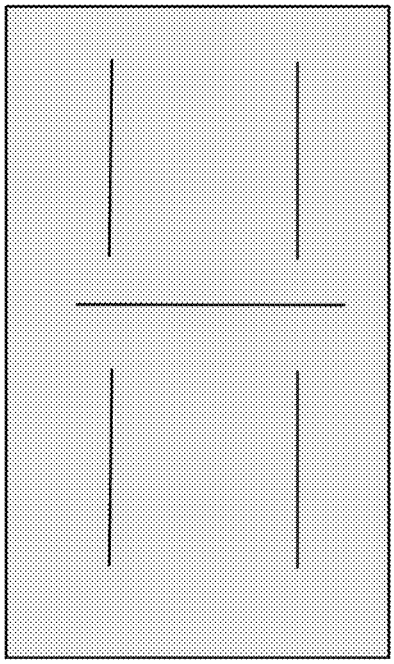
Figure 3C:
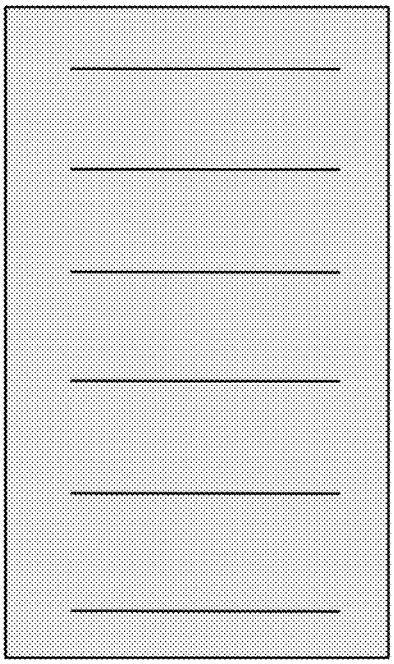
Figure 3D:
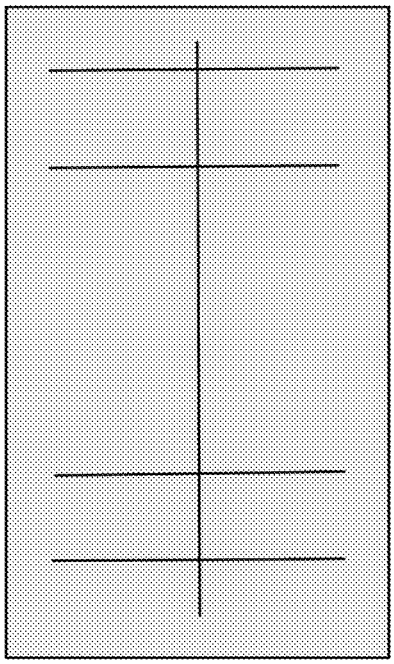

FIG. 3A-3D are illustrations of embodiments of arranging inertial sensors in a yoga under-mat. In one embodiment, the inertial sensors may be arranged in a strip, which covers a portion of the area of the yoga under-mat. FIG. 3A illustrates an X-shaped arrangement, while FIG. 3B shows a horizontal sensor and four vertical sensors distributed in the four quadrants of the yoga under-mat. FIG. 3C shows six stripes of horizontal sensors, covering the mat. FIG. 3D shows a long vertical sensor through the entire yoga under-mat, crossed by four horizontal sensors. Each of these sensor arrangements may be utilized, as may other sensor arrangements.

In one embodiment, the sensor arrangement may be optimized for the type of exercise, or type of yoga, being performed on the mat. For example, yin yoga which primarily has seated postures held for a longer time may be best monitored by the X-shaped sensor, because the user is likely positioned in the center of the mat. Compare that to vinyasa yoga in which shapes flow into each other, which may be best targeted by the series of parallel sensors in a line, because the user will be moving around on the mat continuously. Contrast that with body weight exercises which may be best monitored by the vertical line configuration, because the user is generally stretched along the mat. However, in one embodiment, all configurations are able to monitor the user's bio-data regardless of the form of exercise performed.

In one embodiment, the sensors include piezoelectric inertial sensors which measures changes in force but do not measure static/constant forces. The piezoelectric material generates charge in reaction to changes in force and that charge dissipates over time. That makes such piezoelectric inertial sensors particularly well suited for measuring vital signs which involving constantly changing forces (breathing and heart rate).

Figure 3E:
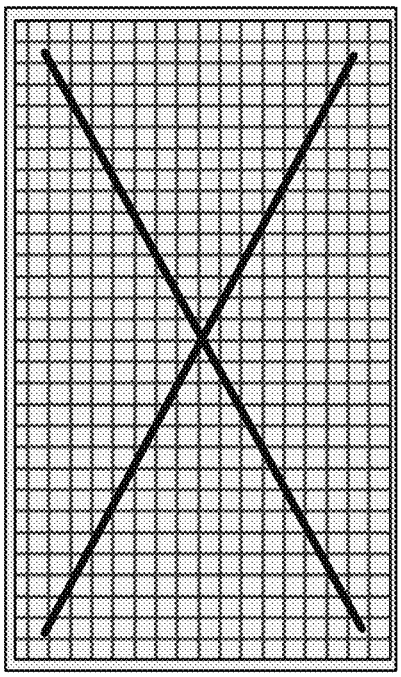
FIGS. 3E-3J are illustrations of embodiments of arranging different types of sensors.

In one embodiment, in addition to an inertial sensor, the system may include a pressure sensor, to measure static pressure. In one embodiment, the pressure sensor may be a uniform sensor through the entire under-mat, as shown in FIG. 3E. In one embodiment, there is a combination of a pressure sensitive array/mat as well as one or more discrete piezoelectric sensors for the optimal combination of monitoring exercise positions such as yoga poses as well as accurate vital signs measurement.

In another embodiment, only a flexible piezoelectric sensor array is used. While this is less precise in monitoring static holds, it indicates the likely yoga position and monitors vital signs.

Figure 3F:
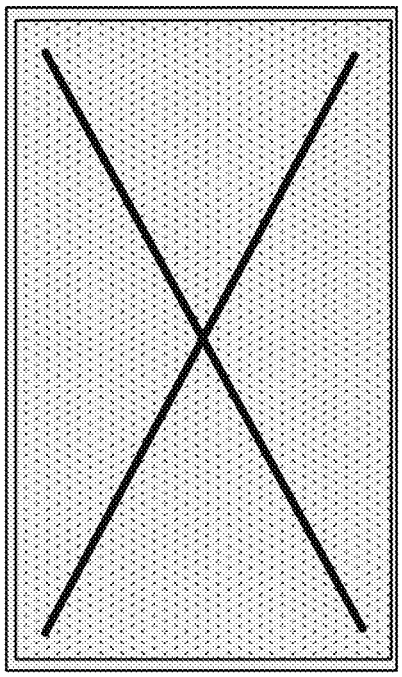
Figure 3G:
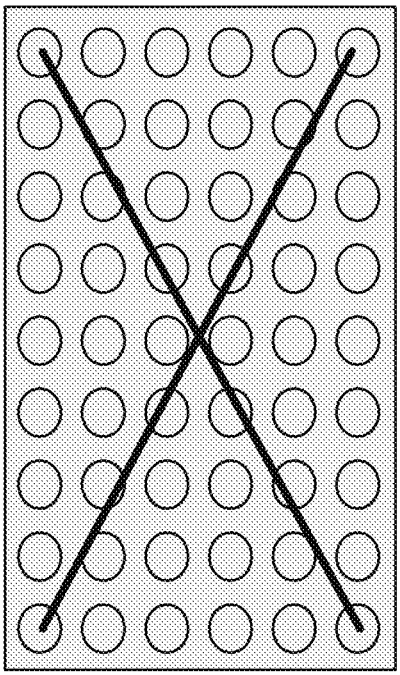

FIGS. 3F through 3G illustrate other configurations for sensors, in which the sensor array may include a plurality of distinct sensors positioned throughout the under-mat. FIGS. 3I and 3J illustrate sensors distributed unevenly, based on expected use of the under-mat. In one embodiment, the sensors are clustered near the center of the under-mat.

Figure 3H:
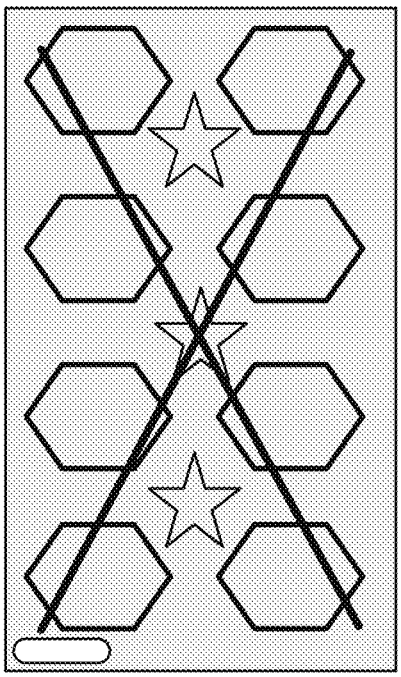
Figure 3I:
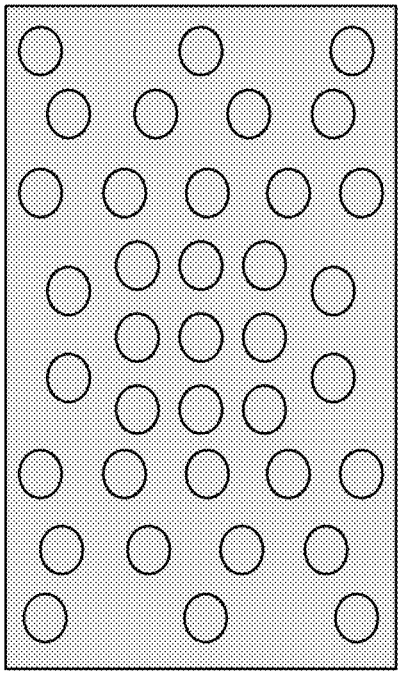
Figure 3J:
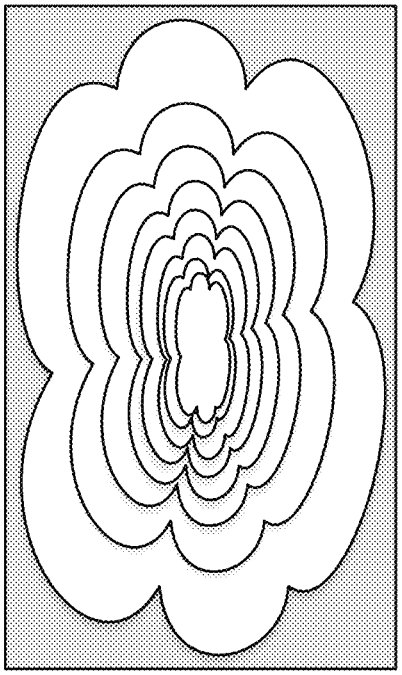

FIG. 3H illustrates three different sensor distributions, which may co-exist or be alternatives. FIG. 3H also shows one embodiment of the processing pod at the bottom corner of the under-mat. In one embodiment, the processing pod provides a processor, memory, buffer, and power to the sensor grid. The processing pod, in one embodiment, also provides a wireless connection to a computing device, either via a personal area network (PAN) such as Bluetooth, a local area network such as Wi-Fi, or a wide area network such as cellular networks. In one embodiment, the processing pod collects data from sensors and sends it to a computing device for analysis. In another embodiment, the processing pod provides analysis locally. In one embodiment, the circuit elements within the processing pod are designed to be flexible circuits, so that they are not damaged when the under-mat is rolled up or folded.

Figure 4A:
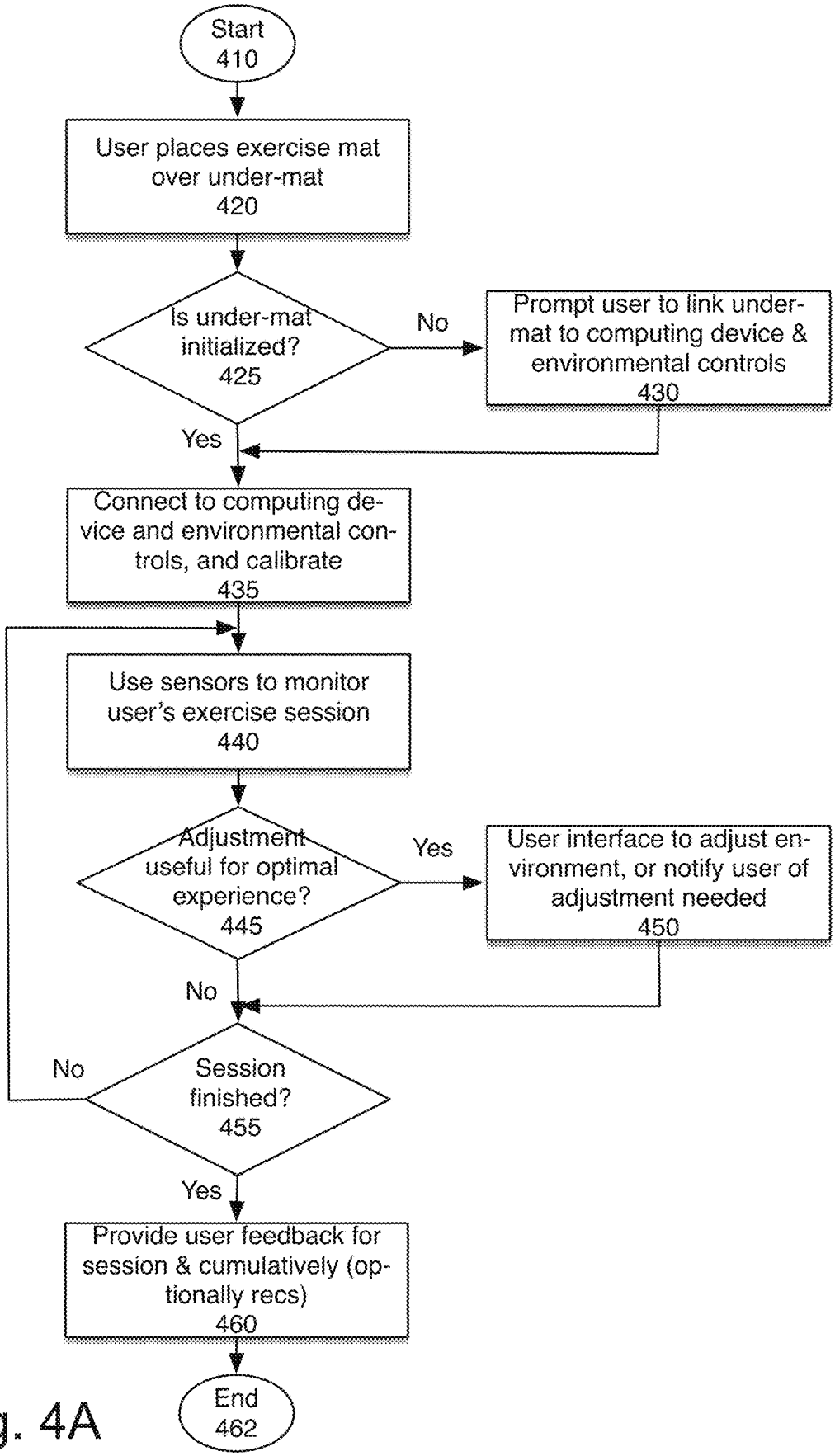
FIG. 4A is a flowchart of one embodiment of using the under-mat for a solo exercise session.

FIG. 4A is a flowchart of one embodiment of using the yoga under-mat for a solo exercise session. The process starts at block 410. The process in one embodiment starts when the user initializes the smart yoga under-mat. At block 420, the user places the exercise mat, or yoga mat on the yoga under-mat.

At block 425, the process determines whether the yoga under-mat has been initialized. The first time the yoga under-mat is used it is initialized. If it has not yet been initialized, at block 430, the user is prompted to link the yoga under-mat to a computing device and initialize environmental controls if available. In one embodiment, the computing device may be a local computer such as the user's smart phone, laptop, tablet, or other computer. In one embodiment, the initialization may involve downloading an application to the computer. In another embodiment, the computing device may be a server device accessed through a network, and the linking comprises providing a wireless network connection to the yoga under-mat. The process then continues to block 435.

If the yoga under-mat has been previously initialized, the process continues directly to block 435. At block 435, the under-mat establishes the connection to the computing device and environmental controls previously set up. In one embodiment, if the yoga under-mat is unable to connect, it may alert the user to set up the link anew. In one embodiment, at block 435, the process also calibrates the under-mat sensors. Sensor calibration, in one embodiment is initiated when the under-mat is placed in position and turned on, and the exercise mat is laid on top of the under-mat. This is detected by the sensors. The calibration ensures that the user's position and movement is accurately detected despite the exercise mat between the user and the sensors.

The process then continues to block 440.

Figure 4B:
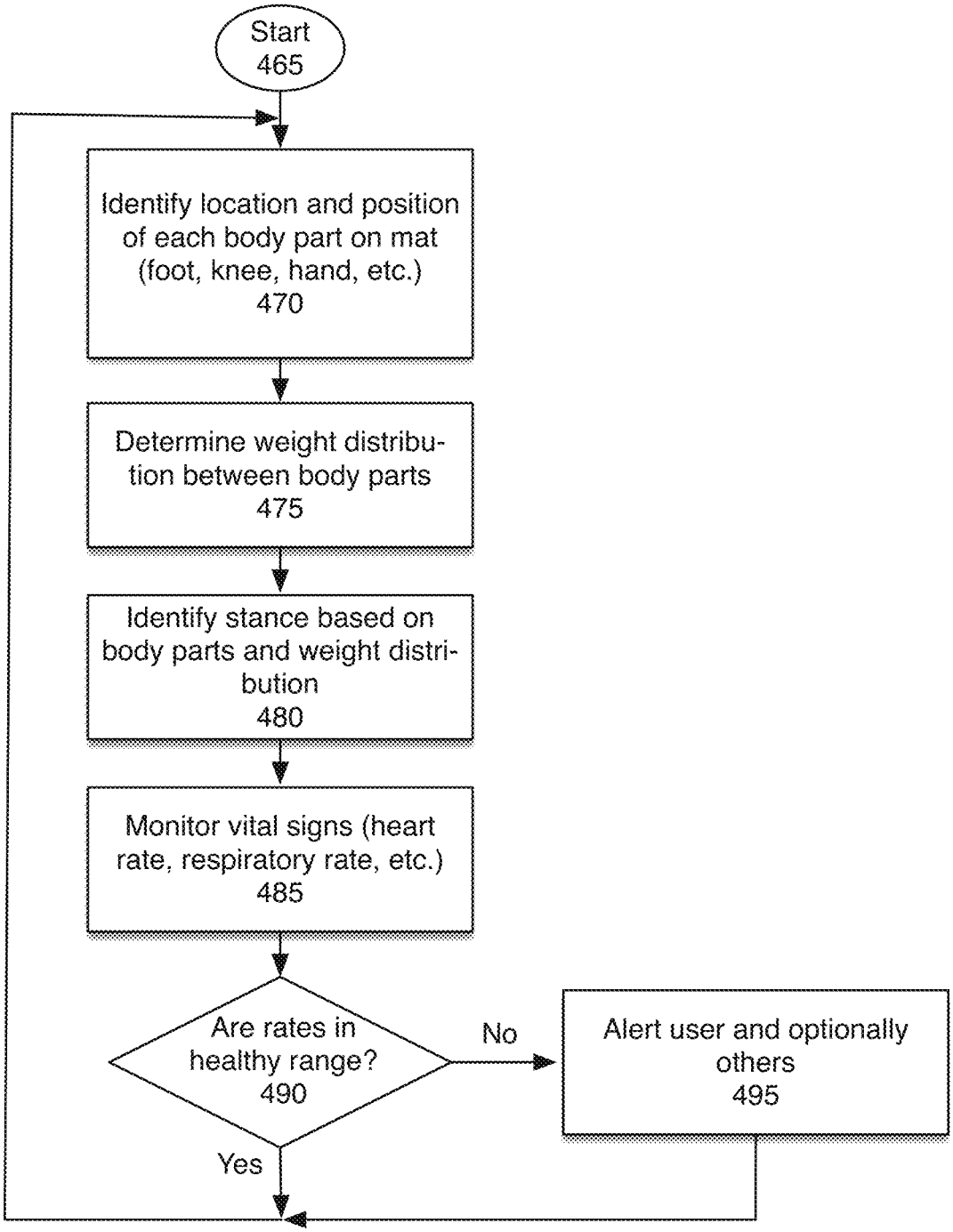
FIG. 4B is a flowchart of one embodiment of monitoring the user.

At block 440, the system uses the sensors in the yoga under-mat to monitor the user's exercise session. FIG. 4B provides a flowchart describing that monitoring.

At block 445, the process determines whether adjusting something, either in the environment, the user's stance, or something else, would be useful to optimize the user's exercise experience. If so, at block 450, the adjustment is made if possible, or the user is alerted to make the adjustment. In one embodiment, for example, if the yoga under-mat is coupled to a thermostat control, either directly or indirectly, the system may adjust the temperature. If the yoga under-mat does not have access to a thermostat, the user may be alerted that the temperature should be adjusted. In one embodiment, the user is only interrupted and instructed to make a change to the environment manually if it is interfering with the exercise, not just to make a minor improvement.

In one embodiment, non-environmental adjustments may include adjustments to the user's stance (e.g. if the user is performing a particular stance or move incorrectly), alerts regarding the user's heart, respiration or other health indicia (e.g. if the user does not have his or her heart rate in the optimal range), etc. In one embodiment, the notification may be an audio notification, for example an announcement that the user should straighten their back, or even their stance.

At block 455, the process determines whether the session is finished. If the session is not yet finished, the process continues to monitor the user's session at block 440.

If the session is finished, at block 460 feedback is provide to the user. In one embodiment, the feedback may not be pushed, but rather the system collects the data and makes it available to the user on request. In another embodiment, the data may be pushed to the user via the application. In one embodiment, the data from the session may also be pushed to other applications, such as activity monitors or health applications. In one embodiment, cumulative data is provided as well. In one embodiment, the user is also given recommendations for future exercise sessions. Such recommendations may include adjustments to the exercise type, length, intensity, etc. or to other factors such as the location, time of day, and environmental conditions for future exercise sessions. The process then ends at block 462. In one embodiment, the user's data is anonymized and provide to a recommendation engine, which collects data over many session and many users to improve its deep learning system, which drives the recommendations.

FIG. 4B is a flowchart of one embodiment of monitoring a user with the yoga under-mat. In one embodiment, this corresponds to block 440 in FIG. 4A. The process in one embodiment, starts when the user monitoring is initiated, and the user steps onto the yoga under-mat.

At block 470, the system identifies the location and position of one or more body parts on the yoga under-mat. The body parts may include the user's feet, knees, hands, hips, etc.

At block 475, the system determines the weight distribution between the body parts. In one embodiment, based on the weight distribution, as determined by an inductive sensor in one embodiment, the system can determine if a portion of the user's weight is off the yoga under-mat. In one embodiment, the user may be alerted to utilize the mat.

At block 480, the process determines the user's stance. In one embodiment, the system may infer the user's stance based on the percentage of the user's weight and position and location of body parts available. In one embodiment, the stance determination may describe a particular stance in yoga. Based on the combination of body position and weight distribution, the system can differentiate between stances which appear similar based on position, for example downward facing dog and plank. In one embodiment, the user's stance is described as the user's position in three dimensional space.

At block 485, the system monitors the user's vital signs, such as the heart rate and respiratory rate. In one embodiment, this monitoring is done via a sensitive inductive sensor which utilizes the body motion, and acts as a ballistocardiograph to monitor the user's heartbeat. In one embodiment, a microphone may also be used to monitor respiration rate and/or heart rate. In one embodiment, data from a variety of bio-monitors are integrated to form a more complete picture of the user's state.

At block 490, the process determines whether the user's rates (heart rate, respiratory rate, etc.) are in healthy/safe ranges. If so, the process continues to monitor at block 470. If not, at block 495, the user and optionally others are alerted. In one embodiment, the healthy range for a heart rate is based on the user data, e.g. the user's age and health, historical data about the user (if available), and the current activity. If the user's heart rate or respiratory rate is significantly elevated during a non-strenuous yoga pose, for example, that may be considered being outside a healthy range, while the same heart rate or respiratory rate would be considered in a healthy range when the user is doing sit-ups or doing something more strenuous.

Figure 5:
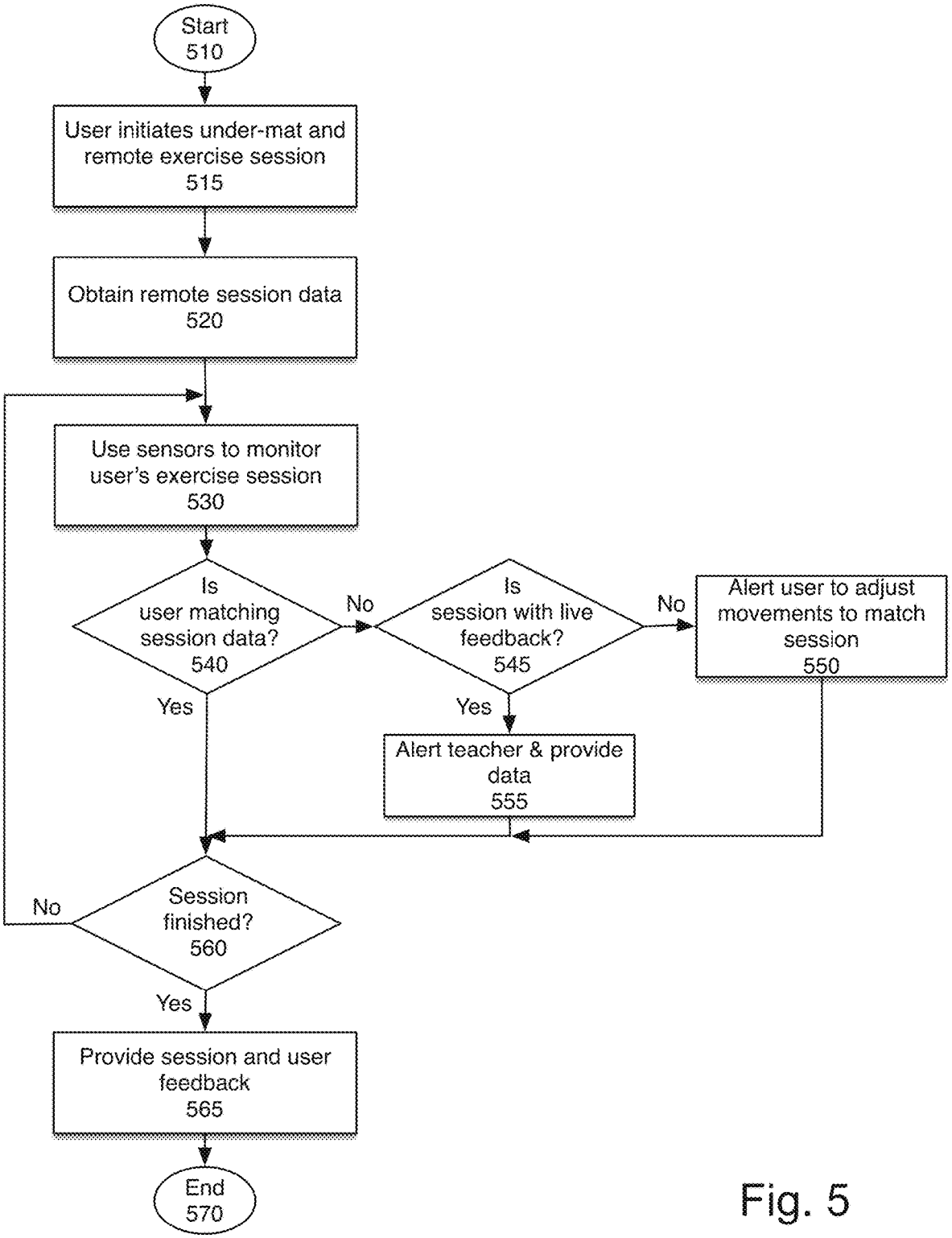
FIG. 5 is a flowchart of one embodiment of using the under-mat for a group session.

FIG. 5 is a flowchart of one embodiment of using the yoga under-mat for a group session. A group session enables a user to participate in interactive yoga or other exercise sessions, either in person or remotely. In one embodiment, the group session may also utilize a prerecorded instructor, rather than a live user session.

The process starts at block 510. At block 515, the user initiates the yoga under-mat and exercise session. In one embodiment, the exercise session has an associated identification code which is provided to the application associated with the yoga under-mat. In another embodiment, the exercise session may be provided through the application associated with the yoga under-mat. In that case, the system automatically obtains the session data. The session data, in one embodiment, provides information about the sequence of exercises, and pacing.

At block 530, the sensor is used to monitor the user's exercise session. As noted previously, the monitoring may include determining the user's stance, heart rate, respiratory rate, and other information.

At block 540, the process determines whether the user's data matches the session data. In one embodiment, this verifies that the user's stance and weight balance match the stance and weight balance in the session. If the user's data does not match, at block 545, the process determines whether this s a live session. In a live session, at block 555 the teacher is alerted. The teacher can then provide specific instruction to the user. If this is not a live session, at block 550 the user maybe alerted to adjust their movement to match the session. In one embodiment, the alert may be specific pointing out the mismatch (e.g. your feet are too closely together) or may simply be a reminder to pay closer attention to the instruction (e.g. your stance does not match the recommended stance.)

The process then continues to block 560, where it determines whether the session is finished. If not, the process continues to monitor, at block 530. Otherwise, at block 565, session and user feedback are provided. In one embodiment, the user is provided feedback regarding their overall performance. In one embodiment, the user is provided a rating for their performance. In one embodiment, the user's performance rating is also provided to the instructor or session organizer. In one embodiment, this data may be provided in an anonymized fashion. The process then ends at block 570.

Of course, though FIGS. 4A, 4B, and 5 are shown as flowcharts, in one embodiment the processes may be implemented as interrupt-driven systems, for example the monitoring for the end of a session or for the detection of unhealthy heart or respiration rate may be continuous, and interrupt driven. Additionally, unless the blocks are dependent on each other, the ordering of the process steps may be varied without departing from the scope of this disclosure.

Figure 6:
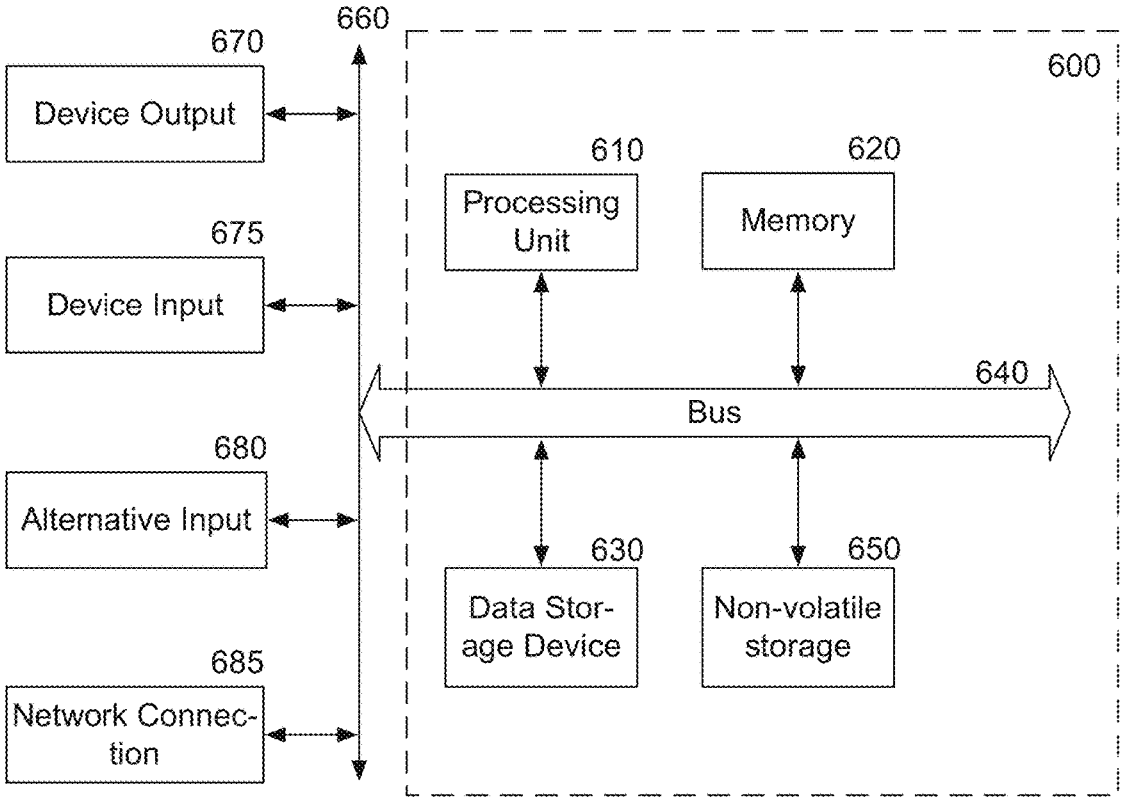
FIG. 6 is a block diagram of one embodiment of a computer system that may be used with the present invention.

FIG. 6 is a block diagram of one embodiment of a computer system that may be used with the present invention. It will be apparent to those of ordinary skill in the art, however that other alternative systems of various system architectures may also be used.

The data processing system illustrated in FIG. 6 includes a bus or other internal communication means 640 for communicating information, and a processing unit 610 coupled to the bus 640 for processing information. The processing unit 610 may be a central processing unit (CPU), a digital signal processor (DSP), or another type of processing unit 610.

The system further includes, in one embodiment, a random access memory (RAM) or other volatile storage device 620 (referred to as memory), coupled to bus 640 for storing information and instructions to be executed by processor 610. Main memory 620 may also be used for storing temporary variables or other intermediate information during execution of instructions by processing unit 610.

The system also comprises in one embodiment a read only memory (ROM) 650 and/or static storage device 650 coupled to bus 640 for storing static information and instructions for processor 610. In one embodiment, the system also includes a data storage device 630 such as a magnetic disk or optical disk and its corresponding disk drive, or Flash memory or other storage which is capable of storing data when no power is supplied to the system. Data storage device 630 in one embodiment is coupled to bus 640 for storing information and instructions.

The system may further be coupled to an output device 670, such as a cathode ray tube (CRT) or a liquid crystal display (LCD) coupled to bus 640 through bus 660 for outputting information. The output device 670 may be a visual output device, an audio output device, and/or tactile output device (e.g. vibrations, etc.)

An input device 675 may be coupled to the bus 660. The input device 675 may be an alphanumeric input device, such as a keyboard including alphanumeric and other keys, for enabling a user to communicate information and command selections to processing unit 610. An additional user input device 680 may further be included. One such user input device 680 is cursor control device 680, such as a mouse, a trackball, stylus, cursor direction keys, or touch screen, may be coupled to bus 640 through bus 660 for communicating direction information and command selections to processing unit 610, and for controlling movement on display device 670.

Another device, which may optionally be coupled to computer system 600, is a network device 685 for accessing other nodes of a distributed system via a network. The communication device 685 may include any of a number of commercially available networking peripheral devices such as those used for coupling to an Ethernet, token ring, Internet, or wide area network, personal area network, wireless network or other method of accessing other devices. The communication device 685 may further be a null-modem connection, or any other mechanism that provides connectivity between the computer system 600 and the outside world.

Note that any or all of the components of this system illustrated in FIG. 6 and associated hardware may be used in various embodiments of the present invention.

It will be appreciated by those of ordinary skill in the art that the particular machine that embodies the present invention may be configured in various ways according to the particular implementation. The control logic or software implementing the present invention can be stored in main memory 620, mass storage device 630, or other storage medium locally or remotely accessible to processor 610.

It will be apparent to those of ordinary skill in the art that the system, method, and process described herein can be implemented as software stored in main memory 620 or read only memory 650 and executed by processor 610. This control logic or software may also be resident on an article of manufacture comprising a computer readable medium having computer readable program code embodied therein and being readable by the mass storage device 630 and for causing the processor 610 to operate in accordance with the methods and teachings herein.

The present invention may also be embodied in a handheld or portable device containing a subset of the computer hardware components described above. For example, the handheld device may be configured to contain only the bus 640, the processor 610, and memory 650 and/or 620.

The handheld device may be configured to include a set of buttons or input signaling components with which a user may select from a set of available options. These could be considered input device #1 675 or input device #2 680. The handheld device may also be configured to include an output device 670 such as a liquid crystal display (LCD) or display element matrix for displaying information to a user of the handheld device. Conventional methods may be used to implement such a handheld device. The implementation of the present invention for such a device would be apparent to one of ordinary skill in the art given the disclosure of the present invention as provided herein.

The present invention may also be embodied in a special purpose appliance including a subset of the computer hardware components described above, such as a kiosk or a vehicle. For example, the appliance may include a processing unit 610, a data storage device 630, a bus 640, and memory 620, and no input/output mechanisms, or only rudimentary communications mechanisms, such as a small touch-screen that permits the user to communicate in a basic manner with the device. In general, the more special-purpose the device is, the fewer of the elements need be present for the device to function. In some devices, communications with the user may be through a touch-based screen, or similar mechanism. In one embodiment, the device may not provide any direct input/output signals but may be configured and accessed through a website or other network-based connection through network device 685.

It will be appreciated by those of ordinary skill in the art that any configuration of the particular machine implemented as the computer system may be used according to the particular implementation. The control logic or software implementing the present invention can be stored on any machine-readable medium locally or remotely accessible to processor 610. A machine-readable medium includes any mechanism for storing information in a form readable by a machine (e.g. a computer). For example, a machine readable medium includes read-only memory (ROM), random access memory (RAM), magnetic disk storage media, optical storage media, flash memory devices, or other storage media which may be used for temporary or permanent data storage. In one embodiment, the control logic may be implemented as transmittable data, such as electrical, optical, acoustical or other forms of propagated signals (e.g. carrier waves, infrared signals, digital signals, etc.).

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

We claim:

1. A monitoring system comprising:

an under-mat for placement under an exercise mat, the under-mat including a plurality of sensors arranged in a pattern, the pattern for the sensors comprises a first line sensors and a second line sensor arranged in an X configuration, and data from the plurality of sensors is used to identify a stance of a user on the exercise mat, and monitor the user's vital signs; and a computer coupled to the under-mat to provide user feedback.

2. The monitoring system of claim 1, wherein the under-mat utilizes an inertial sensor.

3. The monitoring system of claim 1, wherein the user's stance is determined based on a position of each body part on the under-mat and weight distribution between the body parts.

4. The monitoring system of claim 3, wherein the under-mat detects when the user is partially off the under-mat.

5. The monitoring system of claim 1, wherein the identification of the stance of the user occurs on a remote server.

6. The monitoring system of claim 1, wherein the identification of the stance of the user occurs on the computer coupled to the under-mat, wherein the computer comprises a mobile device.

7. The monitoring system of claim 6, wherein the computer is coupled to the under-mat via a wireless connection, and wherein the mobile device is coupled to a remote server via a network.

8. The monitoring system of claim 7, wherein the wireless connection comprises a Bluetooth connection.

9. The monitoring system of claim 1, further comprising:

class logic to enable teaching of a remote class, where data from the under-mat is used to ensure that the user's form matches the class.

10. A method of providing an exercise tracker utilizing a yoga under-mat placed below an exercise mat, the method comprising:

receiving data from a plurality of sensors embedded in the yoga under-mat;

determining a user's movements during an exercise session utilizing the data from the plurality of sensors;

detecting a user's heart rate and respiration rate during the exercise session utilizing the data from the plurality of sensors;

utilizing a special-purpose processor to calculate the user's stances during the exercise session based on the data from the plurality of sensors; and instructing the user to correct the user's stances.

11. The method of claim 10, wherein the plurality of sensors are arranged in a pattern, and the pattern comprises a first line sensors and a second line sensor arranged in an X configuration.

12. The method of claim 10, wherein one or more of the plurality of sensors are in the under-mat.

13. The method of claim 12, wherein the one or more of the sensors in the under-mat include an inertial sensor.

14. The method of claim 10, further comprising:

determining the user's stance based on a position of each body part on the under-mat and weight distribution between the body parts.

15. The method of claim 14, further comprising:

detecting when the user is partially off the under-mat.

16. The method of claim 10, wherein the special-purpose processor is coupled to the plurality of sensors via a wireless connection.

17. The method of claim 10, further comprising:

enabling teaching of a remote class, where the data from under-mat is used to determine whether the user's stance is correct.

18. An exercise monitoring system comprising:

an under-mat for placement under an exercise mat, the under-mat including a plurality of sensors arranged in a pattern, the plurality of sensors collecting sensor data when the under-mat is in use;

a connection to receive the sensor data from the plurality of sensors, the connection to send data to a remote server;

a processor in the remote server configured to use data from the plurality of sensors to determine a user's stance based on a position of each body part on the under-mat and weight distribution between the body parts;

the processor configured to further use the data to determine the user's vital signs; and a user interface configured to provide feedback to the user based on the determination.

19. The exercise monitoring system of claim 18, wherein the plurality of sensors comprise a first line sensors and a second line sensor arranged in an X configuration.

20. The exercise monitoring system of claim 18, further comprising:

a heart rate logic to detecting a user's heart rate and respiration rate when the under-mat is in use utilizing the data from the plurality of sensors.

* * * * *